US011009201B1

(12) United States Patent
Liao

(10) Patent No.: US 11,009,201 B1
(45) Date of Patent: May 18, 2021

(54) SIMULATED CANDLE LAMP

(71) Applicant: Dongguan Shufan Homeware Company Limited, Dongguan (CN)

(72) Inventor: Gengbiao Liao, Heyuan (CN)

( * ) Notice: Subject to any disclaimer, the term of this patent is extended or adjusted under 35 U.S.C. 154(b) by 0 days.

(21) Appl. No.: 17/134,273

(22) Filed: Dec. 26, 2020

(51) Int. Cl.

| | |
|---|---|
| ***F21S 10/04*** | (2006.01) |
| ***F21S 6/00*** | (2006.01) |
| ***F21Y 115/10*** | (2016.01) |
| ***F21V 23/04*** | (2006.01) |
| ***F21V 23/00*** | (2015.01) |
| ***F21S 9/02*** | (2006.01) |
| *F21W 121/00* | (2006.01) |

(52) U.S. Cl.
CPC ..... *F21S 10/04* (2013.01); *F21S 6/001* (2013.01); *F21S 9/02* (2013.01); *F21V 23/003* (2013.01); *F21V 23/045* (2013.01); *F21W 2121/00* (2013.01); *F21Y 2115/10* (2016.08)

(58) Field of Classification Search
CPC ..... F21S 10/01; F21S 10/04
See application file for complete search history.

(56) References Cited

U.S. PATENT DOCUMENTS

2015/0036348 A1* 2/2015 Dong ..... F21V 14/08 362/293
2015/0338042 A1* 11/2015 Patton ..... F21V 31/005 348/742
2016/0109083 A1* 4/2016 Li ..... F21S 9/02 362/84
2017/0356604 A1* 12/2017 Huang ..... F21S 9/02
2019/0063703 A1* 2/2019 Hurduc ..... F21S 10/046

* cited by examiner

*Primary Examiner* — Jong-Suk (James) Lee
*Assistant Examiner* — Eric T Eide
(74) *Attorney, Agent, or Firm* — W&K IP

(57) ABSTRACT

Disclosed is a simulated candle lamp, which includes a fixing bottom ring; a battery box installed in the fixing bottom ring; a control PCB installed on the side of the battery box; a transfer PCB installed on top of the battery box; a lower coil fixing member installed above the transfer PCB; a transmitter coil and a swing coil installed in the lower coil fixing member; a housing mounted at the upper end of the lower coil fixing member; an upper coil fixing member installed in the housing; a magnet and a receiver coil installed in the upper coil fixing member where the magnet is arranged above the swing coil, and the receiver coil is arranged above the transmitter coil; an LED fixture arranged above the upper coil fixing member; and an LED light-emitting diode mounted on the LED fixture.

9 Claims, 7 Drawing Sheets

SIMULATED CANDLE LAMP

TECHNICAL FIELD

This disclosure relates to the field of lamps, and more particularly relates to a simulated candle lamp.

BACKGROUND

Existing electronic candles on the market either have limited illumination and flicker capabilities, or may have full illumination capability but without flicker effect. In addition, the simulated flame flicker designs are all fixed modes set with a control program, and cannot provide the flickering sensation of an actual candle which burns unsteadily when it is disturbed by an airflow. As such, the eyes would be tired with the fixed flicker pattern, and cannot truly experience the flame visual effect of an actual burning candle.

SUMMARY

In order to overcome the above-mentioned deficiencies, this disclosure provides a technical solution that can solve the above-mentioned problems.

There is provided a simulated candle lamp, which includes a fixing bottom ring. A battery box is fixedly installed in the fixing bottom ring. Batteries are installed in the battery box. A control PCB is installed on the side of the battery box. A transfer PCB is installed on top of the battery box. A lower coil fixing member is installed above the transfer PCB. A transmitter coil and a swing coil are fixedly installed in the lower coil fixing member. The upper end of the lower coil fixing member is fixedly mounted with a housing, and an upper coil fixing member is installed in the housing. A magnet and a receiver coil are fixedly installed in the upper coil fixing member, where the magnet is arranged above the swing coil, and the receiver coil is arranged above the transmitter coil. An LED-PCB is fixedly installed above the upper coil fixing member. A bracket is installed above the LED-PCB, and an LED fixture is arranged above the bracket. An LED light-emitting diode is fixedly mounted on the LED fixture, and the upper end of the LED fixture is installed with a flame head by means of a clearance fit.

The batteries supply power to the control PCB, and the control PCB supplies power to the transmitter coil and the swing coil via the transfer PCB. The swing coil drives the magnet to swing up and down, while power is transmitted from the transmitter coil to the receiver coil, to the LED-PCB, to the LED light-emitting diode in succession. Consequently, the LED light-emitting diode achieves a lighting effect through the flame head.

As a further solution of the present disclosure, the lower end of the battery box passes through the fixing bottom ring. The lower end of the battery box is provided with a battery cover, and a battery plate is fixedly installed on the battery cover whereby the batteries in the battery box realize circuit series connection through the battery plate.

As a further solution of the present disclosure, a buckle is formed on the battery cover, and the battery cover is buckled into the lower end of the battery box through the buckle.

As a further solution of the present disclosure, the housing includes a left housing and a right housing, which are detachably fitted with each other.

As a further solution of the present disclosure, an outer shell is mounted on the outer side of the fixing bottom ring by means of a clearance fit, and the outer shell correspondingly covers the fixing bottom ring, the battery box, the control PCB, and the housing.

As a further solution of the present disclosure, a replaceable support is arranged between the battery box and the housing, where the upper end of the replaceable support is snap-fitted with the lower end of the housing, and the lower end of the replaceable support is inserted into the upper end of the battery box by means of a clearance fit.

As a further solution of the present disclosure, a remote controller is further provided, where a wireless communicative connection is created between the remote controller and the control PCB.

As a further solution of the present disclosure, the battery is implemented as a disposable battery or a rechargeable battery.

As a further solution of the present disclosure, a black simulated cotton core is arranged at the lower side of the flame head.

In comparison against the related art, the present disclosure may be able to provide the following beneficial effects. In particular, the present disclosure adopts the design principle of wireless transmission mode of electric energy so that the simulated candle lamp provided by the disclosure has both the electromagnetic field-driven flame swing mode and the external natural wind-driven flame swing mode without the magnetic field. The luminous flame portion does not need to use the traditional wired connection to achieve power transmission, and is supplied with the power required for luminescence. The use of wireless power transmission design enable this product to achieve a 360-degree luminous mode and a 360-degree flame swing direction free of dead angles, which avoids the wired gravity-driven mechanical swing amplitude and fixed swing directions that are present with traditional wired power transmission, thus resulting in a smoother swing motion of the glowing flame. At the same time, the swing distance will lead to the instability of the electric energy transmission received by the luminous flame portion, which makes the luminous portion produce a flickering effect, thus realizing the high visual simulation of a burning candle in the natural state, bringing a full range of high simulation visual experience.

Additional aspects and advantages of the present disclosure partly will be provided in the following description, and partly will become apparent from the following description, or be understood through the practice of the present disclosure.

BRIEF DESCRIPTION OF DRAWINGS

For a better understanding of the technical solutions reflected in the embodiments according to the present disclosure or those in the related art, the drawings used in the description of the embodiments or the related art will be briefly introduced below. Apparently, the drawings in the following description merely represent some embodiments of the present disclosure, and for those having ordinary skill in the art, other drawings may also be obtained based on these drawings without investing creative efforts.

Figure 1:
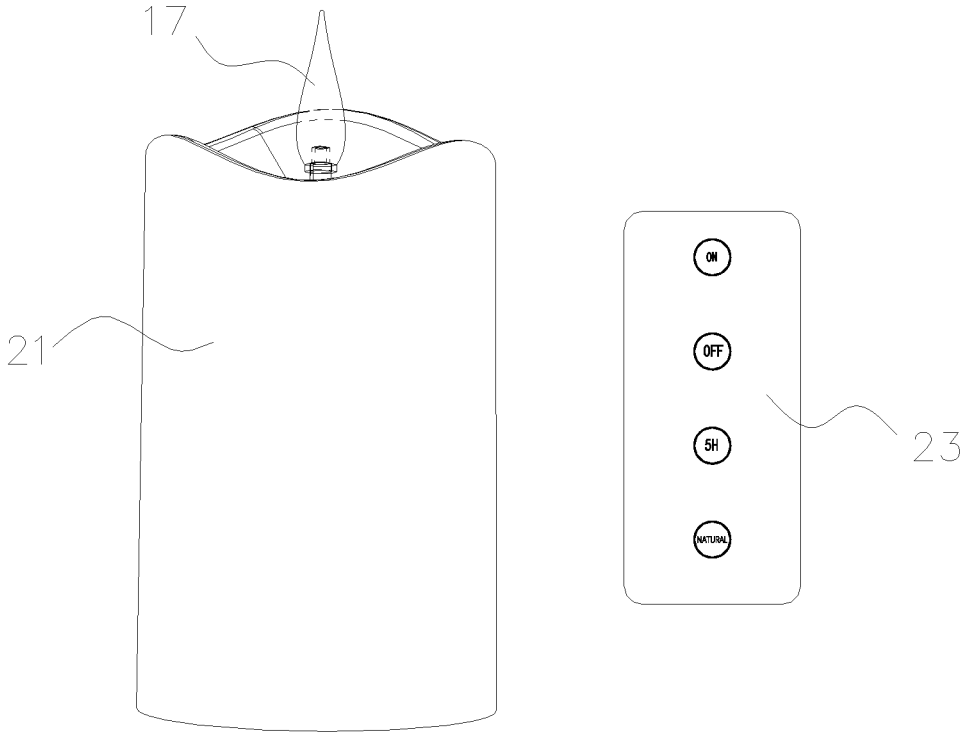
FIG. 1 is a schematic diagram illustrating the present disclosure.

In the drawings: 1. Fixing bottom ring; 2. Battery box; 3. Battery; 4. Control PCB; 5. Transfer PCB; 6. Lower coil fixing member; 7. Transmitter coil; 8. Swing coil; 9. Housing; 10. Upper coil fixing member; 11. Magnet; 12. Receiver coil; 13. LED-PCB; 14. Bracket; 15. LED fixture; 16. LED light-emitting diode; 17. Flame head; 18. Battery cover 19. Battery plate; 20. Buckle; 91. Left housing; 92. Right housing; 21. Outer shell; 22. Replaceable support; 23. Remote controller; 24. Black simulated cotton core.

DETAILED DESCRIPTION

Hereinafter, technical solutions in the embodiments of the present disclosure will be described in a definite and comprehensive manner in connection with the accompanying drawings in the embodiments of the present disclosure. It will be apparent that the embodiments described herein represent merely a part rather than all of the embodiments in accordance with the present disclosure. All other embodiments obtained by a person having ordinary skill in the art based on the embodiments disclosed herein without making creative efforts shall all fall in the scope of protection of the present disclosure.

Figure 2:
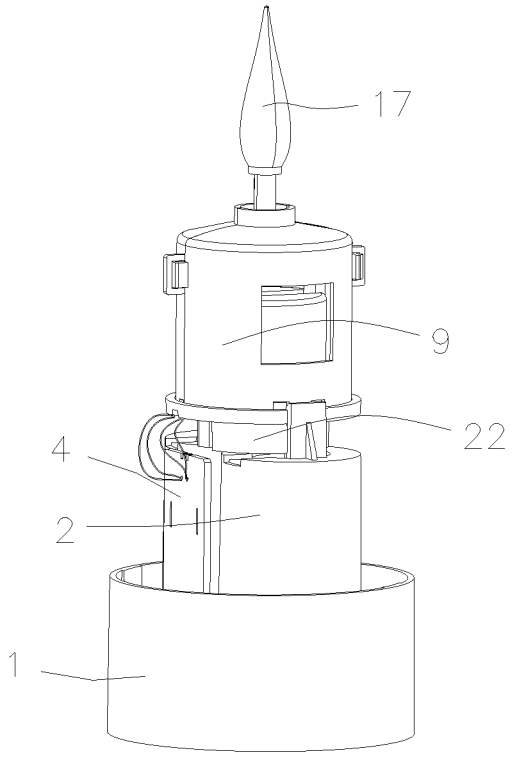
FIG. 2 is a schematic diagram illustrating the internal structure of the present disclosure.
Figure 3:
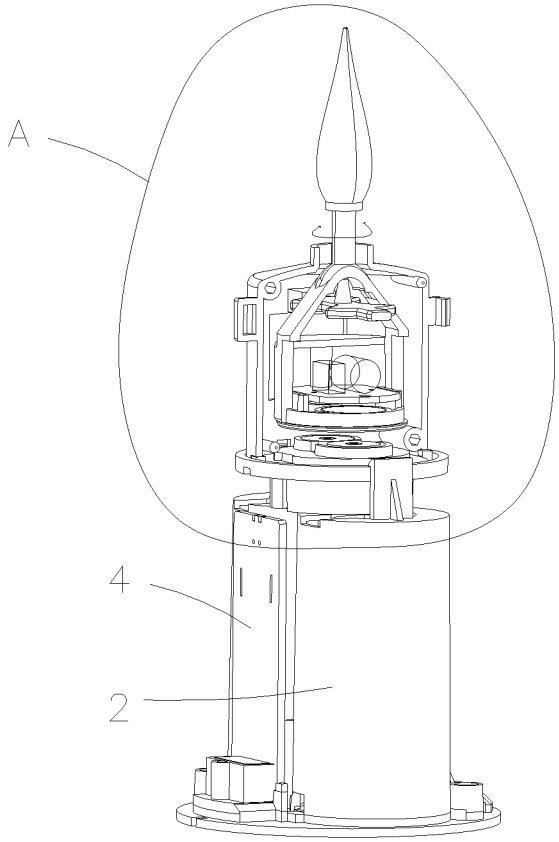
FIG. 3 is a schematic diagram illustrating the present disclosure omitting the right housing.
Figure 4:
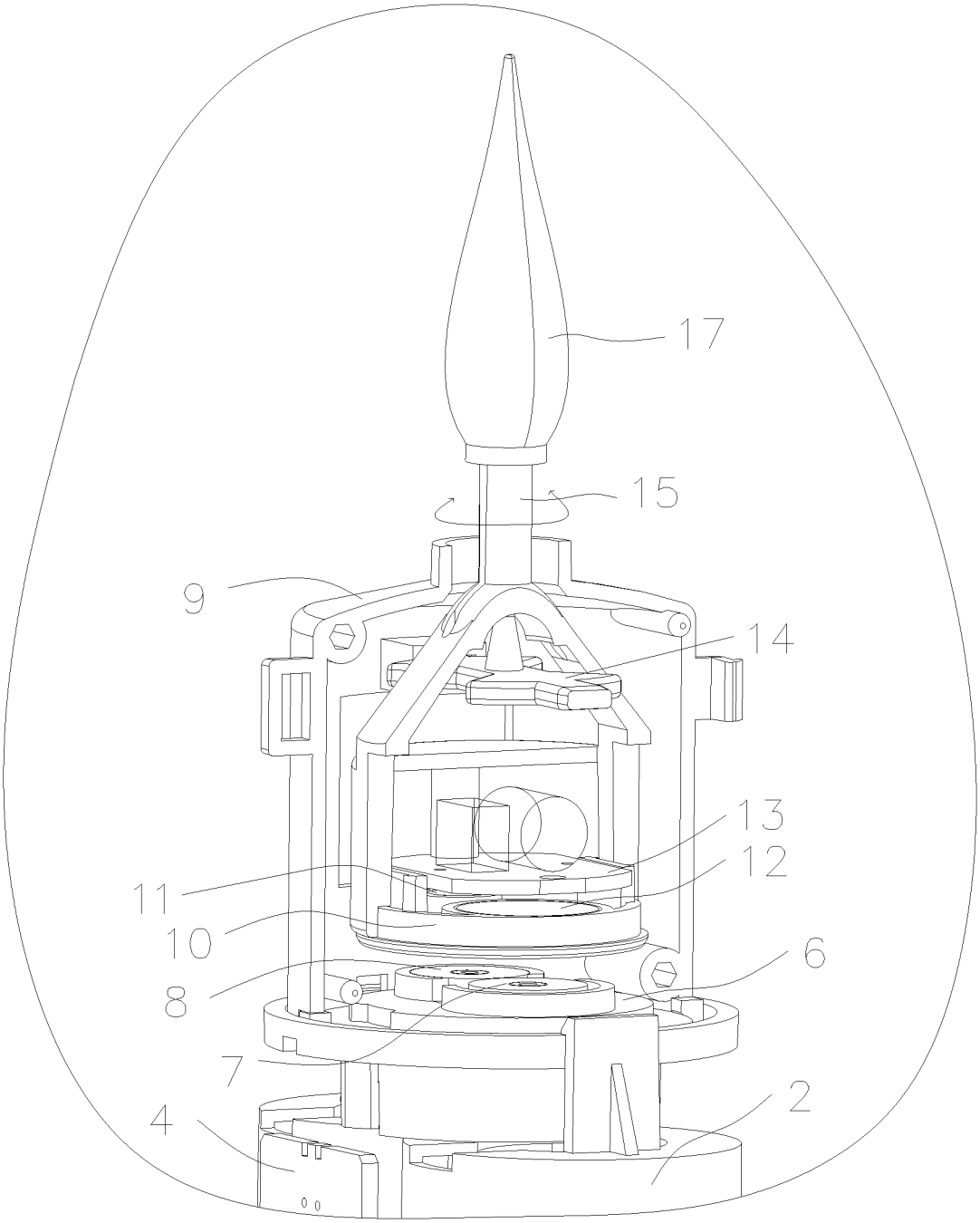
FIG. 4 is an enlarged view of portion A shown in FIG. 3.
Figure 5:
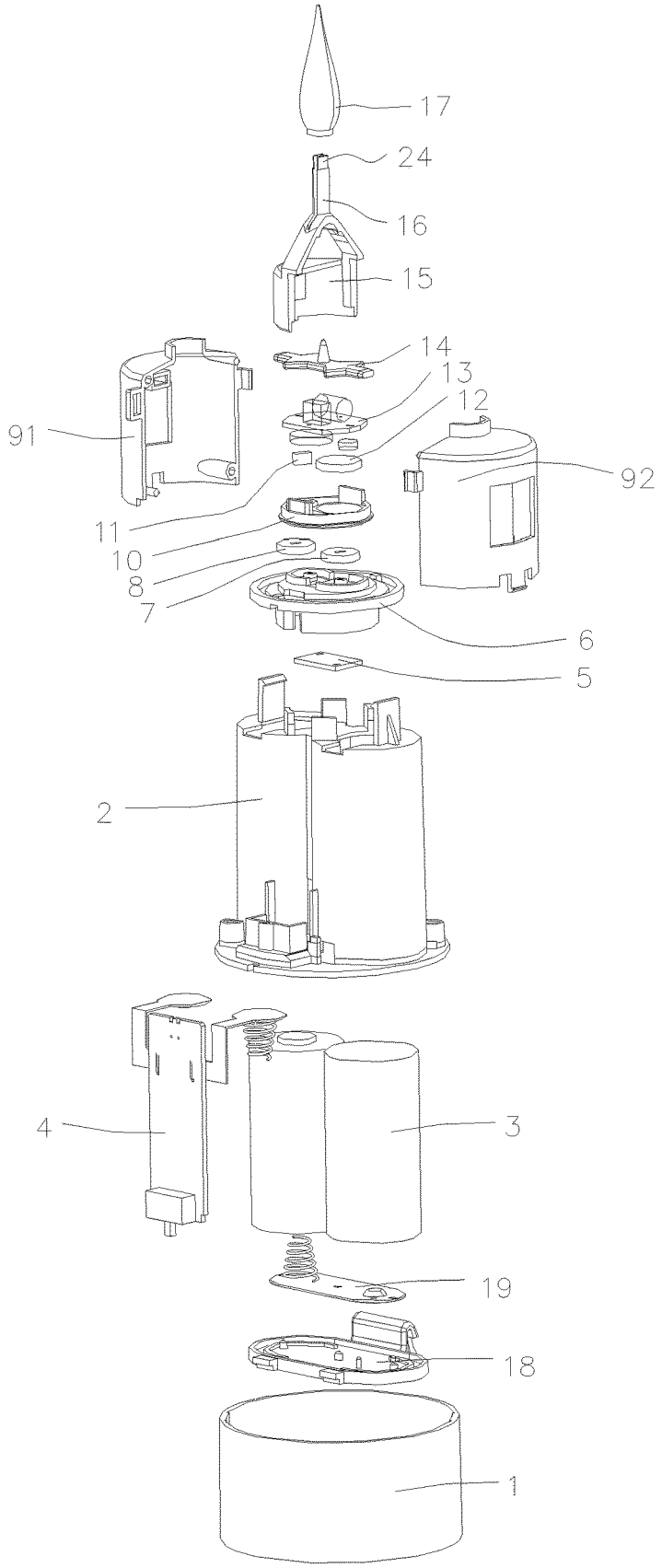
FIG. 5 is an explosive diagram of the present disclosure.
Figure 6:
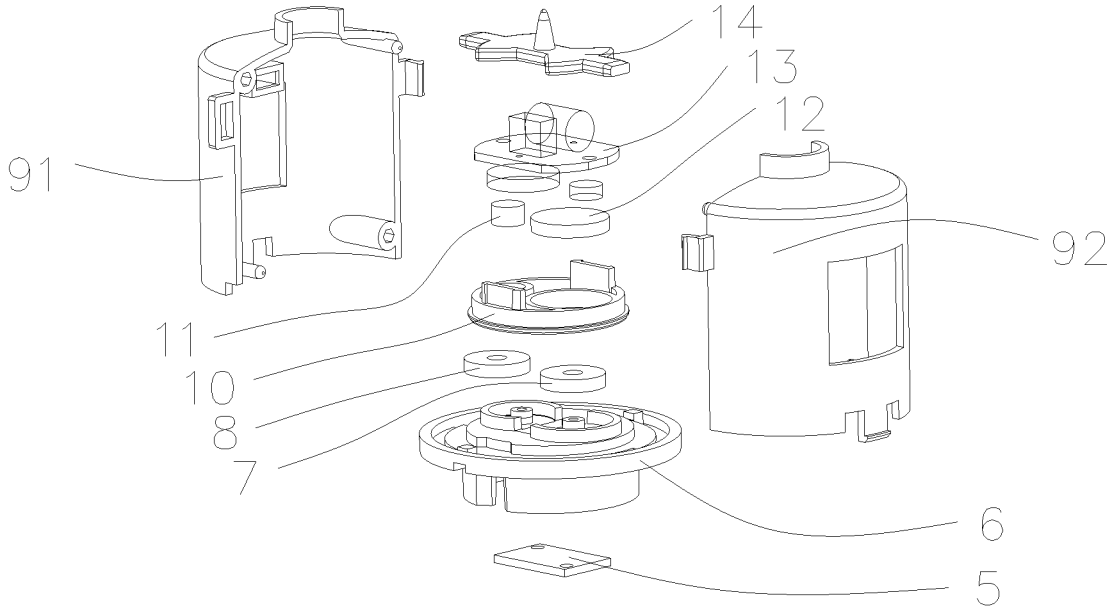
FIG. 6 is an explosive diagram of the housing of the present disclosure.
Figure 7:
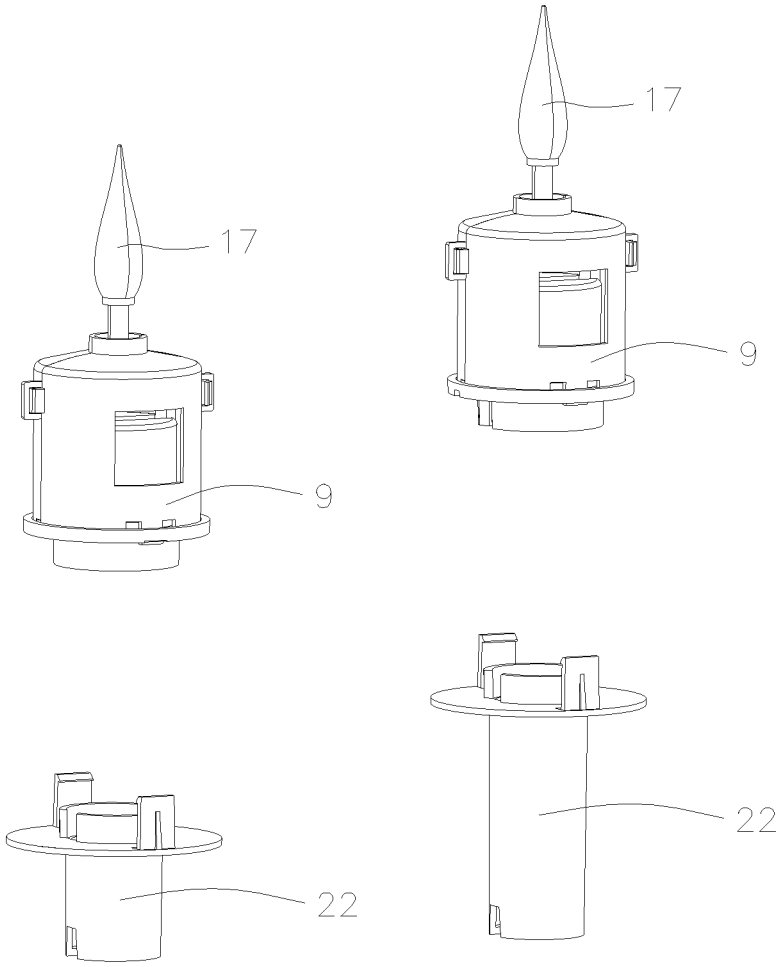
FIG. 7 is a schematic diagram illustrating the housing of the present disclosure installed with replaceable supports of different lengths.

Referring to FIGS. 1-7, there is provided a simulated candle lamp, which includes a fixing bottom ring 1. A battery box 2 is fixedly installed in the fixing bottom ring 1. Batteries 3 are installed in the battery box 2. A control PCB 4 is installed on the side of the battery box 2. A transfer PCB 5 is installed on top of the battery box 2. A lower coil fixing member 6 is installed above the transfer PCB 5. A transmitter coil 7 and a swing coil 8 are fixedly installed in the lower coil fixing member 6. The upper end of the lower coil fixing member 6 is fixedly mounted with a housing 9, and an upper coil fixing member 10 is installed in the housing 9. A magnet 11 and a receiver coil 12 are fixedly installed in the upper coil fixing member 10, where the magnet 11 is arranged above the swing coil 8, and the receiver coil 12 is arranged above the transmitter coil 7. An LED-PCB 13 is fixedly installed above the upper coil fixing member 10. A bracket 14 is installed above the LED-PCB 13, and an LED fixture 15 is arranged above the bracket 14. An LED light-emitting diode 16 is fixedly mounted on the LED fixture 15, and the upper end of the LED fixture 15 is installed with a flame head 17 by means of a clearance fit.

The batteries 3 supply power to the control PCB 4, and the control PCB 4 supplies power to the transmitter coil 7 and the swing coil 8 via the transfer PCB 5. The swing coil 8 drives the magnet 11 to swing up and down, while power is transmitted from the transmitter coil 7 to the receiver coil 12, to the LED-PCB 13, to the LED light-emitting diode 16 in succession. Consequently, the LED light-emitting diode 16 achieves a lighting effect through the flame head 17.

As a further solution of the present disclosure, the lower end of the battery box 2 passes through the fixing bottom ring 1. The lower end of the battery box 2 is provided with a battery cover 18, and a battery plate 19 is fixedly installed on the battery cover 18 whereby the batteries 3 in the battery box 2 realize circuit series connection through the battery plate 19. Thus, the batteries 3 can be disassembled and replaced, making it convenient to use.

As a further solution of the present disclosure, a buckle 20 is formed on the battery cover 18, and the battery cover 18 is buckled into the lower end of the battery box 2 through the buckle. Thus, the installation of the battery cover 18 is more stable while the battery cover 18 is detachable.

As a further solution of the present disclosure, the housing 9 includes a left housing 91 and a right housing 92, which are detachably fitted with each other. Thus, the installation and disassembly of the internal parts of the housing 9 can be facilitated.

As a further solution of the present disclosure, an outer shell 21 is mounted on the outer side of the fixing bottom ring 1 by means of a clearance fit, and the outer shell 21 correspondingly covers the fixing bottom ring 1, the battery box 2, the control PCB 4, and the housing 9. This makes the novel simulated candle lamp have a more smooth and aesthetic appearance.

As a further solution of the present disclosure, a replaceable support 22 is arranged between the battery box 2 and the housing 9, where the upper end of the replaceable support 22 is snap-fitted with the lower end of the housing 9, and the lower end of the replaceable support 22 is inserted into the upper end of the battery box 2 by means of a clearance fit. Thus, the replaceable support 22 can be designed to have different lengths so that the height of the LED light-emitting diode 16 can be adjusted.

As a further solution of the present disclosure, a remote controller 23 is further provided, where a wireless communicative connection is created between the remote controller 23 and the control PCB 4. Thus, the control PCB 4 can be controlled by the remote controller 23, facilitating the use.

As a further solution of the present disclosure, the battery 3 is implemented as a disposable battery or a rechargeable battery.

As a further solution of the present disclosure, a black simulated cotton core 24 is arranged at the lower side of the flame head 17, thus achieving a high degree of visual simulation.

The working principle of the disclosure is as follows.

1. Wireless transmission for light emission. After the present disclosure is loaded with the batteries 3, the control PCB 4 may issue a function command. At this time, there may be a specific pulse current passing through the transmitter coil 7, so that the transmitter coil 7 may generate an electromagnetic field and transmit it upward to the receiver coil 12. The receiver coil 12 may be induced by the specific pulse magnetic field emitted by the transmitter coil 7 and then transfer the energy to the LED-PCB 13 to convert the energy into electric energy and transfer it to the LED light-emitting diode 16, and accordingly the LED light-emitting diode 16 will emit a bright light.

2. Flame swing. In a normal working state of this product, the control PCB 4 may issue a function command. At this time, the swing coil 8 sends out a short-term pulse magnetic field and generates a magnetic field having the same pole as the magnet 11. Thus, the fixed installation of the swing coil 8 and the magnetic field having the same pole that is emitted by the swing coil 8 are utilized to push the movable magnet 11 together with the LED fixture 15 to perform a swing motion. Because the amplitude of the swing will cause the distance between the receiver coil 12 and the transmitter coil 7 to change, the energy received by the receiver coil 12 will accordingly also experience a change. Therefore, the amount of converted electrical energy will also change, and affect the brightness of the LED light-emitting diode 16, causing the brightness of the LED light-emitting diode 16 to flicker in an inconstant manner, thereby forming a visual sense of light and shadow flickering.

3. Remote control device. When the product is powered on, the remote controller 23 can be used to switch the function of the product, and the product can be turned on or off. Furthermore, the remote controller 23 can add a timing loop function to the product, and switch the swing mode, that is, one can choose to use the product's own power supply driven swing function or switch to the swing mode that is driven by natural wind in the environment without using power supply.

At the current technological level, the remote control technology of the remote controller 23 has been very mature in various fields of the society, and it does not belong to the scope of protection of the technical solutions herein, so it is not detailed in the above structure.

For those skilled in the art, it is apparent that the present disclosure will not be limited to the details of the above exemplary embodiments, and the present disclosure can be implemented in other specific forms without departing from the spirit or basic characteristics of the present disclosure. Therefore, no matter from what point of view, the embodiments should be considered exemplary, and not limiting. The scope of the present disclosure will be defined in and by the appended claims rather than by the foregoing description, and so it is intended that all changes falling within the meaning and scope of equivalent elements of the claims shall all be encompassed in the present disclosure. Any reference signs in the claims should not be regarded as limiting the claims involved.

What is claimed is:

1. A simulated candle lamp, comprising:

a fixing bottom ring;

a battery box, fixedly installed in the fixing bottom ring, and comprising batteries that are installed in the battery box;

a control PCB, installed on a side of the battery box;

a transfer PCB, installed on top of the battery box;

a lower coil fixing member, installed above the transfer PCB;

a transmitter coil and a swing coil, which are fixedly installed in the lower coil fixing member;

a housing, which is fixedly mounted to an upper end of the lower coil fixing member;

an upper coil fixing member, installed in the housing;

a magnet and a receiver coil, which are fixedly installed in the upper coil fixing member, wherein the magnet is arranged above the swing coil, and the receiver coil is arranged above the transmitter coil; an LED-PCB, fixedly installed above the upper coil fixing member; a bracket, installed above the LED-PCB;

an LED fixture, arranged above the bracket;

an light-emitting diode, fixedly mounted on the LED fixture; and a flame head, installed at an upper end of the LED fixture by means of a clearance fit;

wherein the batteries are configured to supply power to the control PCB, and the control PCB is configured to supply power to the transmitter coil and the swing coil through the transfer PCB, wherein the swing coil is configured to drive the magnet to swing up and down, while power is transmitted from the transmitter coil to the receiver coil, to the LED-PCB, and to the light-emitting diode in succession, and wherein the light-emitting diode is operative to effectuate a lighting effect through the flame head.

2. The simulated candle lamp of claim 1, wherein a lower end of the battery box passes through the fixing bottom ring and is provided with a battery cover, and wherein a battery plate is fixedly installed on the battery cover whereby the batteries in the battery box are operative to be connected in series through the battery plate.

3. The simulated candle lamp of claim 2, wherein a buckle is formed on the battery cover, and wherein the battery cover is buckled into the lower end of the battery box through the buckle.

4. The simulated candle lamp of claim 1, wherein the housing comprises a left housing and a right housing, which are detachably fitted with each other.

5. The simulated candle lamp of claim 1, further comprising:

an outer shell, mounted on an outer side of the fixing bottom ring by means of a clearance fit, and configured to correspondingly cover the fixing bottom ring, the battery box, the control PCB, and the housing.

6. The simulated candle lamp of claim 1, further comprising:

a replaceable support, arranged between the battery box and the housing, wherein an upper end of the replaceable support is snap-fitted with the lower end of the housing, and a lower end of the replaceable support is inserted into the upper end of the battery box by means of a clearance fit.

7. The simulated candle lamp of claim 1, further comprising a remote controller, which forms a wireless communicative connection with the control PCB.

8. The simulated candle lamp of claim 1, wherein the batteries comprise a disposable battery or a rechargeable battery.

9. The simulated candle lamp of claim 1, further comprising a black simulated cotton core that is arranged at a lower side of the flame head.

* * * * *